US006387854B1

(12) United States Patent
Sedelmeier et al.

(10) Patent No.: US 6,387,854 B1
(45) Date of Patent: May 14, 2002

(54) RAILROAD LUBRICATING COMPOSITION

(75) Inventors: Gregory Jude Sedelmeier, Houston; Robert Joel Taylor, The Woodlands, both of TX (US)

(73) Assignee: Texaco Inc., White Plains, NY (US)

( * ) Notice: Subject to any disclaimer, the term of this patent is extended or adjusted under 35 U.S.C. 154(b) by 0 days.

(21) Appl. No.: 09/795,388

(22) Filed: Feb. 28, 2001

(51) Int. Cl.[7] ..... C10M 107/34; C10M 105/18
(52) U.S. Cl. ..... 508/579
(58) Field of Search ..... 508/579

(56) References Cited

U.S. PATENT DOCUMENTS 5,415,896 A * 5/1995 Mulvihill et al. ..... 427/388.4
5,492,642 A * 2/1996 Mulvihill et al. ..... 252/52 A

* cited by examiner

*Primary Examiner*—Ellen M. McAvoy
(74) *Attorney, Agent, or Firm*—Morris N. Reinisch; Reed Smith LLP

(57) ABSTRACT

A composition for lubricating the top of a rail is disclosed. The composition is composed of:

(a) 25 to 45 wt % of a first polyoxyalkylene glycol comprising a linear copolymer of ethylene oxide and propylene oxide copolymer and having an average molecular weight of about 2,500;

(b) 0.5 to 3.0 wt % of a second polyoxyalkylene glycol comprising a linear copolymer of ethylene oxide and propylene oxide copolymer and having an average molecular weight of about 12,000;

(c) 5 to 35 wt % of a solvent; and (d) a rust inhibitor.

Methods of making and using the composition are also disclosed.

16 Claims, No Drawings

RAILROAD LUBRICATING COMPOSITION

BACKGROUND OF THE INVENTION

The present invention relates to a railroad lubricating composition and a method of lubricating the top of a rail.

In railroad lubrication, the top of a rail is lubricated to reduce lateral creep of a wheel which causes increased wheel flange-rail interaction. Wheel flange-rail interaction results in wear and additional fuel use and in the extreme is a contributing factor in derailment.

One of the benefits derived from a good top of the rail lubricant is that maximum safe speeds at which a train can run with worn equipment, termed Hunting speed, is increased. Increased train speed in a rail network can result in improved business operations such as meeting schedules and improved equipment utilization.

A top of the rail lubricant is applied after the locomotive has passed, providing lubrication for the rail car wheels. It is desirable that a top of the rail lubricant not persist on the rail after the train has passed. A persistent lubricant would reduce traction for the next locomotive passing on the track.

U.S. Pat. No. 5,492,642, which is hereby incorporated by reference, discloses a lubricant and a method for lubricating the top of a rail. The lubricant, however, does not perform well under moderate and extreme conditions of heat, i.e., when rail crown temperatures reach 130° F. or higher. In particular, in actual field studies conducted during warmer months of the year, the lubricant was found to be insufficient for effective lubrication as it was consumed too quickly by the heat generated by the passage of a train over hot tracks. In fact, only ⅙th of the rail was adequately protected by the lubricant during the field studies. Certainly, the trailing cars in a train consist would not be adequately lubricated if a lubricant is consumed too quickly. Further, the assertion in U.S. Pat. No. 5,492,642 that "the lubricating composition is consumed in 5 to 15 minutes in the heat generated by a passing train" has proven to be inadequate in environments where the temperature is in excess of 75° F. Also, the use of an alcohol in the composition of U.S. Pat. No. 5,492,642 has been found to accelerate the consumption of the lubricant too much for effective rail lubrication under moderate and extreme heat and is considered an unnecessary component of the composition.

Accordingly, it is one of the purposes of this invention, among others, to provide a top of the rail lubricant which is able to withstand greater ranges of temperature extremes in order to ensure satisfactory performance throughout the year. The lubricant must also be environmentally innocuous, ensure wheel and rail protection, decrease friction between a wheel and a rail, and reduce energy consumption needed to power a train consist over a wide range of temperatures.

SUMMARY OF THE INVENTION

It has now been discovered that this and other purposes can be achieved by the present invention which provides for a railroad lubricating composition and a method for lubricating the top of a rail. The lubricating composition is applied to the top of the rail in an amount sufficient to lubricate the wheel and rail interface and be consumed in the heat generated by the passage of one train. This aqueous lubricating composition represents an improvement over the composition described in U.S. Pat. No. 5,492,642 in that it will provide effective lubrication at temperatures ranging from 160 ° F down to −45° F. and that alcohol is not necessary in the lubricating composition.

The lubricating composition of the present invention includes a synthetic lubricant, a synthetic thickener, a volatilizable solvent and a rust inhibitor.

The synthetic lubricant is a first polyoxyalkylene glycol including a linear copolymer of ethylene oxide and propylene oxide copolymer. The first polyoxyalkylene glycol has an average molecular weight of about 2,500. Further, the first polyoxyalkylene glycol is 25 to 45 wt % of the lubricating composition, preferably 30 to 40 wt % of the lubricating composition.

The synthetic thickener is a second polyoxyalkylene glycol including a linear copolymer of ethylene oxide and propylene oxide copolymer. The second polyoxyalkylene glycol has an average molecular weight of about 12,000. Further, the second polyoxyalkylene glycol is 0.5 to 3.0 wt % of the lubricating composition, preferably 1 to 2 wt % of the lubricating composition.

The volatilizable solvent is preferably propylene glycol. The solvent is 5 to 35 wt % of the lubricating composition, preferably 10 to 30 wt % of the lubricating composition.

Suitable rust inhibitors for the lubricating composition include phosphates, polyphosphates, sodium benzoate, quaternary amines, borax, amine borates, sodium borates, sodium molybdate, alkali metal nitrates, alkyl carboxylates, benzo tolyl triazoles, sulfonates, zinc salts, morpholine amines, ammonia, ethylenediamines, hydrazine, immadazolines, formamide, alkanolamines, carbonates, bicarbonates, sodium silicates, metasilicates, sodium chromates, calcium hydroxide, calcium bicarbonates, sodium nitrate and sodium chromate.

The lubricating composition is consumable, i.e., vaporizable. It evaporates in the heat and friction generated by the passage of the train over the rails.

The present invention also provides for a method of lubricating the top of a rail including applying a lubricating composition in an amount sufficient to wet the rail in the heat generated by the passing of a train. The lubricating composition applied in this method preferably includes a synthetic lubricant, a synthetic thickener, a volatilizable solvent and a rust inhibitor as described above.

DETAILED DESCRIPTION OF THE INVENTION

The lubricating composition and method of the present invention relies on an aqueous mixture of the first and second polyoxyalkylene glycols.

The first polyoxyalkylene glycol is 25 to 45 wt %, preferably 30 to 40 wt %, of the lubricating composition. The content of the first polyoxyalkylene glycol in the lubricating composition is critical to the effectiveness of the lubricanting composition over a wide range of temperatures. Also, the first polyoxyalkylene glycol has an average molecular weight of about 2,500. A suitable first polyoxyalkylene glycol is a commercially available sample of Jeffox WL-1400, a functional fluid made by the Huntsman Corporation.

By including a higher content of the first polyxyalkylene glycol in the lubricating composition and a lower molecular weight first polyoxyalkylene glycol in comparison to the composition disclosed by U.S. Pat. No. 5,492,642, the top of the rail lubricating composition is effective in lubricating the rail under all extremes of temperature.

The second polyoxyalkylene glycol is 0.5 to 3.0 wt %, preferably 1 to 2 wt %, of the lubricating composition. Also, the second polyoxyalkylene glycol has an average molecular weight of about 12,000. A suitable second polyoxyalkylene glycol is UCON® 75-H-90000 which has an average molecular weight of approximately 10,300 and a viscosity of approximately 90,000 Saybolt Universal Seconds (SUS) at 100° F. (37.8° C.).

The lubricating composition also includes a volatilizable solvent which is propylene glycol. Propylene glycol is 5 to 35 wt %, preferably 10 to 35 wt %, of the lubricating composition.

The lubricating composition also includes a rust inhibitor. An example of a suitable rust inhibitor is Gateway ADDCO CP-105 brand which is a cathodic amine borate.

The lubricating composition does not include an alcohol as required in the composition of U.S. Pat. No. 5,492,642. In fact, the use of the alcohol in the composition of U.S. Pat. No. 5,492,642 has been found to accelerate the consumption of the lubricant too much for effective rail lubrication under moderate and extreme heat and is considered an unnecessary component of a lubricating composition.

The lubricating compositions of the present invention are formulated by methods well known in the art which can be carried out continuously. Some minor heat (100° F.) may need to be added to a stainless steel kettle to accelerate the mixing of the viscous second polyoxyalkylene glycol thickener. Continuous stirring is recommended to maintain homogeneity as each individual component is added. Mixing of the final composition is recommended for 20 additional minutes once all components have been added.

The finished top of rail lubricating composition of the invention is designed to be filled into the tank of a locomotive mounted applicator, specifically the SENTRAEN 2000, and applicator developed by the Tranergy Corporation and detailed in U.S. Pat. No. 4,930,600. The composition is a consumable lubricant, which is the term used in the art for a lubricant that evaporates in the heat and friction generated by the passage of a train over the rails. Complete consumption of the top of rail lubricant allows for the next locomotive to pass over the rail without loss of traction or loss of the electric communication link through the rail (known as "shunting"). The lead locomotive in a train is not lubricated, but the trailing cars are. The lubricator is mounted to the trailing locomotive.

U.S. Pat. No. 5,492,642 discloses that "the lubricating composition is consumed in 5 to 15 minutes in the heat generated by a passing train". U.S. Pat. No. 5,492,642 also discloses that laboratory tests of top of the rail lubricants on the Illinois Institute of Technology (IIT) wheel rail simulation rig showing lubricant consumption in 5 to 15 minutes would correlate with field data. However, it has been shown by field studies that consumption rates of 5 to 15 minutes as predicted by the IIT wheel rail simulation rig are not adequate to ensure lubricity of a top of rail lubricant under moderate to extreme heat on the rail. To correlate well with data determined in the field, the top of rail lubricant must last at least 45–60 minutes with heat (of 130° F. or higher) applied to the wheel and rail interface on the IIT wheel rail simulator rig during testing.

The following examples are provided to assist in further understanding the present invention. The particular materials and conditions employed are intended to be further illustrative of the invention and are not limiting upon the reasonable scope thereof.

Several top of the rail lubricating compositions were prepared and tested to illustrate features and advantages of the present invention.

In particular, the lubricating compositions were tested in a laboratory using the Illinois Institute of Technology (IIT) Wheel Rail Simulation rig. This test rig comprises a one twelfth (1/12) scale wheel and rail for rail lubricating testing.

The following examples show that the top of the rail lubricating compositions of the present invention have significantly improved consumption times compared to prior art lubricating compositions.

EXAMPLES 1 AND 2

TABLE 1 shows the composition and characteristics of Examples 1 and 2 which are lubricating compositions encompassed by U.S. Pat. No. 5,492,642.

Example 1 showed a consumption time of 6 minutes when heat (at a temperature of 130° F. or higher) was applied to the test rig wheel/rail interface. Heat was applied via a small heat lamp. Example 2 showed a consumption time under heat of 12 minutes, which represents an improvement over Example 1, but would not be a significant improvement in actual field operation. The main difference between Example 1 and Example 2 is that ethanol was not used in the composition of Example 2 as it was in the composition of Example 1. Instead, propylene glycol was substituted for ethanol in Example 2. Also, the amount of the first polyoxyalkylene glycol synthetic lubricant was slightly increased in Example 2 as compared to Example 1. Field data have shown that the consumption time of Examples 1 and 2 are inadequate to withstand even a moderately hot environment. As determined through field data, a lubricant must last at least 45–60 minutes with heat (of 130° F. or higher) applied to the IIT wheel rail simulator during testing to be effective.

EXAMPLES 3–5

TABLE 1 shows the composition and characteristics of top of the rail lubricating compositions, Examples 3–5.

Examples 3–5 show the effects of varying the amount of propylene glycol in a lubricating composition. In particular, Examples 3 and 4 include very similar amounts of water and propylene glycol whereas Example 5 shows a composition containing no water and almost twice as much propylene glycol as Examples 3 and 4. The first and second polyoxyalkylenes are varied only slightly in Examples 3–5. The test results for Examples 3–5 from the IIT wheel rail simulator test rig show that Examples 3 and 4 increase the consumption time, but not to the extent necessary and Example 5 has inadequate consumption time.

EXAMPLE 6

TABLE 1 shows the composition and characteristics of the lubricant Example 6.

The lubricant Example 6 showed outstanding results in the IIT wheel rail simulation rig (90 minutes with heat applied at 130° F. or higher, 30 minutes at room temperature of 75° F.). The first polyoxyalkylene glycol (Jeffox WL-1400) was 40.0 wt % of the composition and the ratio of propylene glycol to water was 1:1. This example demonstrates that the amount of the first polyoxyalkylene glycol synthetic lubricant is critical to the consumption characteristics of the top of rail lubricant. The equivalent amounts of propylene glycol and water in this example composition also help to keep the pour point down to −59° F. It is expected that the composition of Example 6 will provide adequate lubrication for the wheel and rail interface in actual train operations for temperatures ranging from 160° F. It is also expected that lubricant Example 6 will provide adequate lubrication for the wheel and rail interface in actual train operations for temperatures ranging from 160° F. down to −45° F.

EXAMPLE 7

TABLE 1 shows the composition and characteristics of lubricating composition Example 7.

Example 7, which does not contain a synthetic lubricant, shows a consumption time of 4 minutes. From Examples 5 and 7, it is apparent that increasing the propylene glycol content will not satisfactorily improve the consumption time of the lubricant. Further, it is clear from Example 7 that a top of rail composition lacking a synthetic lubricant will not provide any significant lubrication for the wheel and rail interface.

EXAMPLES 8–12

TABLE 2 shows the composition and characteristics of top of the rail lubricating compositions, Examples 8–12.

Example 8 is similar to Example 6 in that the ratio of propylene to glycol is 1:1, however, Example 8 includes only 10 wt % of synthetic lubricant (Jeffox WL-1400) and no thickener. Example 8 shows a consumption time of 8 minutes with heat applied to the IIT wheel rail simulation rig at 130° F. or higher. This consumption time is far lower than necessary to maintain adequate rail lubrication. Example 10 below also does not include a thickener and it is apparent from comparing Examples 8 and 10 that the inadequate consumption time of Example 8 can be attributed to the low amount of synthetic lubricant in the composition.

Examples 9–12 include varying amounts of the synthetic lubricant (Jeffox WL-1400) ranging from 25 to 40 wt % of the composition and similar amounts of thickener and propylene glycol except for Example 10 not containing a thickener as mentioned above.

Examples 9–12 show consumption times on the IIT wheel rail simulation rig in excess of 45 minutes with heat applied at 130° F. or higher.

Thus, while there have been described what are presently believed to be the preferred embodiments of the present invention, those skilled in the art will realize that other and further embodiments can be made without departing from the spirit and scope of the invention, and it is intended to include all such further modifications and changes as come within the true scope of the invention.

TABLE 1

| | Example Number | | | | | | |
|---|---|---|---|---|---|---|---|
| | Example 1 | Example 2 | Example 3 | Example 4 | Example 5 | Example 6 | Example 7 |
| Polyoxyalkylene Glycol[1], wt % | 19.30 | 20.30 | 20.30 | 20.30 | 19.70 | — | — |
| Polyoxyalkylene Glycol[6], wt % | — | — | — | — | — | 40.00 | — |
| Thickener[2], wt % | 0.70 | 2.00 | 2.00 | 2.75 | 2.70 | 1.50 | — |
| Propylene Glycol, wt % | 21.70 | 26.00 | 38.60 | 38.225 | 74.40 | 29.00 | 49.72 |
| Ethanol, wt % | 5.00 | — | — | — | — | — | — |
| Deionized Water, wt % | 52.80 | 51.20 | 38.60 | 38.225 | — | 29.00 | 49.72 |
| Rust Inhibitor[3], wt % | 0.50 | 0.50 | 0.50 | 0.50 | 0.50 | 0.50 | 0.56 |
| Wetting Agent[4], wt % | — | — | — | — | 2.00 | — | — |
| Lubricity Agent[5], wt % | — | — | — | — | 0.70 | — | — |
| Viscosity, Kin @ 40° C., cSt | 14.69 | 21.31 | 31.37 | 33.59 | 77.68 | 47.38 | 3.12 |
| Pour Point, ° F., D97 | −40 | — | — | — | −24 | −59 | −67 |
| Consumption Time @ 75° F. | — | — | — | — | — | 30 | — |
| Consumption Time @ 130° F. or higher | 6 | 12 | 27 | 15 | 9 | 90 | 4 |

[1]Jeffox WL-5000, MW = 4365
[2]UCON 75-H-90000, MW = 10,300
[3]Gateway ADDCO CP-105
[4]Chemical LA-9
[5]Lubrhophos LP-700
[6]Jeffox, WL-1400, MW = 2500

TABLE 2

| | Example Number | | | | |
|---|---|---|---|---|---|
| | Example 8 | Example 9 | Example 10 | Example 11 | Example 12 |
| Polyoxyalkylene Glycol[1], wt % | 10.00 | 35.00 | 40.00 | 30.00 | 25.00 |
| Thickener[2], wt % | — | 1.00 | — | 1.00 | 1.00 |
| Propylene Glycol, wt % | 44.75 | 10.00 | 15.00 | 15.00 | 15.00 |
| Ethanol, wt % | — | — | — | — | — |
| Deionized Water, wt % | 44.75 | 53.50 | 44.50 | 53.50 | 58.50 |
| Rust Inhibitor[3], wt % | 0.50 | 0.50 | 0.50 | 0.50 | 0.50 |
| Viscosity, Kin @ 40° C., cSt | 7.18 | 17.36 | — | 13.89 | 9.85 |
| Pour Point, ° F., D97 | −43 | −19 | −66 | −15 | −16 |
| Consumption Time @ 75° F. | — | −50 | 50 | — | 60 |
| Consumption Time @ 130° F. or higher | 8 | 46 | 50 | 52 | 54 |

[1]Jeffox WL-1400, MW = 2500
[2]UCON 75-H-90000, MW = 10,300
[3]Gateway ADDCO CP-105

The present invention is further outlined by the following embodiments:

1. An aqueous, alcohol free lubricating composition for the top of a rail comprising:

(a) 25 to 45 wt % of a first polyoxyalkylene glycol comprising a linear copolymer of ethylene oxide and propylene oxide copolymer and having an average molecular weight of about 2,500;

(b) 0.5 to 3.0 wt % of a second polyoxyalkylene glycol comprising a linear copolymer of ethylene oxide and propylene oxide copolymer and having an average molecular weight of about 12,000;

(c) 5 to 35 wt % of a solvent;

(d) a rust inhibitor; and the remainder water.

2. The lubricating composition of claim 1 wherein the lubricating composition comprises 30 to 40 wt % of the first polyoxyalkylene glycol.

3. The lubricating composition of claim 1 wherein the lubricating composition comprises 1 to 2 wt % of the second polyoxyalkylene glycol.

4. The lubricating composition of claim 1 wherein the linear copolymer of ethylene oxide and propylene oxide copolymer of the second polyoxyalkylene glycol has a molecular weight of about 10,300.

5. The lubricating composition of claim 1 wherein the lubricating composition comprises 10 to 30 wt % of the solvent.

6. The lubricating composition of claim 1 wherein the solvent is propylene glycol.

7. The lubricating composition of claim 1 wherein the rust inhibitor is selected from the group consisting of phosphates, polyphosphates, sodium benzoate, quaternary amines, borax, amine borates, sodium borates, sodium molybdate, alkali metal nitrates, alkyl carboxylates, benzo tolyl triazoles, sulfonates, zinc salts, morpholine amines, ammonia, ethylenediamines, hydrazine, immadazolines, formamide, alkanolamines, carbonates, bicarbonates, sodium silicates, metasilicates, sodium chromates, calcium hydroxide, calcium bicarbonates, sodium nitrate and sodium chromate.

8. A method of lubricating the top of a rail comprising applying a lubricating effective amount of an aqueous, alcohol free composition comprising:

(a) 25 to 45 wt % of a first polyoxyalkylene glycol comprising a linear copolymer of ethylene oxide and propylene oxide copolymer and having an average molecular weight of about 2,500;

(b) 0.5 to 3.0 wt % of a second polyoxyalkylene glycol comprising a linear copolymer of ethylene oxide and propylene oxide copolymer and having an average molecular weight of about 12,000;

(c) 5 to 35 wt % of a solvent;

(d) a rust inhibitor; and the remainder water.

9. The method of claim 8 wherein the composition comprises 30 to 40 wt % of the first polyoxyalkylene glycol.

10. The method of claim 8 wherein the composition comprises 1 to 2 wt % of the second polyoxyalkylene glycol.

11. The method of claim 8 wherein the linear copolymer of ethylene oxide and propylene oxide copolymer of the second polyoxyalkylene glycol has a molecular weight of about 10,300.

12. The method of claim 8 wherein the composition comprises 10 to 30 wt % of the solvent.

13. The method of claim 8 wherein the solvent is propylene glycol.

14. The method of claim 8 wherein the rust inhibitor is selected from the group consisting of phosphates, polyphosphates, sodium benzoate, quaternary amines, borax, amine borates, sodium borates, sodium molybdate, alkali metal nitrates, alkyl carboxylates, benzo tolyl triazoles, sulfonates, zinc salts, morpholine amines, ammonia, ethylenediamines, hydrazine, immadazolines, formamide, alkanolamines, carbonates, bicarbonates, sodium silicates, metasilicates, sodium chromates, calcium hydroxide, calcium bicarbonates, sodium nitrate and sodium chromate.

15. A method for making the lubricating composition of claim 1 comprising mixing the first polyoxyalkylene glycol with the second polyoxyalkylene glycol, adding the solvent and the rust inhibitor to the mixture and mixing the final composition for at least about 20 additional minutes.

16. The method of claim 15 wherein the mixture of the first and second polyoxyalkylene glycols is heated to accelerate the mixing of the viscous second polyoxyalkylene glycol.

* * * * *